United States Patent [19]

Harris

[11] Patent Number: 4,941,214

[45] Date of Patent: Jul. 17, 1990

[54] FLUSH TANK WATER SAVER

[76] Inventor: John L. Harris, 470 Palm Island, NE., Clearwater, Fla. 34630

[21] Appl. No.: 293,454

[22] Filed: Jan. 4, 1989

[51] Int. Cl.[5] ..... E03D 1/14

[52] U.S. Cl. ..... 4/325; 4/415

[58] Field of Search ..... 4/415, 324, 325, 381, 4/382, 383, 384

[56] References Cited

U.S. PATENT DOCUMENTS

| | | | |
|---|---|---|---|
| 2,526,294 | 10/1950 | Stegeman | 4/325 |
| 3,026,536 | 3/1962 | Wood | 4/324 |
| 4,216,555 | 8/1980 | Detjen | 4/324 |

*Primary Examiner*—Linda J. Sholl

[57] ABSTRACT

A flush tank water saver includes a base clamped to the tank overflow pipe and formed with a mechanism base extending over the flapper valve and having a valve operator pivot. This pivot carries an operator extending downward and toward the overflow pipe to a point behind the flapper valve when open. This same pivot also carries a float lever extending past the overflow pipe and having a float on its other side. The operator is spring biased to close the valve and is held in cocked position by a latch on another pivot. This latch is released by a pin on the float lever when the water level lowers to the water saver level. The float lever has a second pin engaged by a blocking surface on the latch when a full flush is desired. At the start of a flush a link with the flush lever moves the operator to cocked position and also moves the latch to float blocking position. If the flush lever is held up until the pin on the float lever is blocked by the blocking surface, a full flush results.

17 Claims, 2 Drawing Sheets

FLUSH TANK WATER SAVER

BACKGROUND OF THE INVENTION

This invention relates to toilet tank controls for selectively providing a water saving flush or a full flush.

It has long been recognized that toilet flush tanks are one of the worst water wasters in existence. They are flushed often and each time use a full tank of water even though less than half would give an adequate flush for most uses.

Many attempts have been made to develop suitable devices giving the user a choice between a short flush and a full flush. However, none has been marketable.

This application is a continuation of the developments disclosed in my application Ser. Nos. 07/030,080 filed March 26, 1987 and 07/067,494 filed June 29, 1987. These prior applications are for attachments to existing flush tank valves to provide water savings.

Applicant's application Ser. No. 07/030,080 filed March 26, 1987 discloses a water saver in which a float type flapper valve is pushed closed for a water saver flush by a float operated lever pivoted near the flapper valve pivots. This eliminates friction loss. This application also discloses an arrangement permitting the user to select between a water saver flush and a full flush. Holding the flush handle down a few seconds provides a full flush. Quick release of the handle provides a water saver flush with no trouble. Just push the handle as if the water saver wasn't there and get a water saver flush.

Application Ser. No.07/067,494 filed June 29, 1987 discloses a water saver having the same advantages as the earlier application and includes an arrangement insuring repeat accuracy of the water saver cut-off point. This consists of a latch for preventing a valve operator from closing the valve. This latch is released by a float at the water saver cut-off point.

SUMMARY OF THE INVENTION

When Applicant filed the earlier applications he was of the opinion the valve operator pivots must be near the flapper valve pivots in order to avoid friction loss. This involved complications in the parts to get the operator pivots at the bottom of the tank.

It has now been discovered that the operator can be located above the flapper valve with insignificant friction loss. This can be achieved by locating the operator pivot in the area of a line from the flapper valve pivots through the area of contact of the valve and operator at mid-stroke.

This location of the operator pivot both reduces the number of parts required and makes the parts smaller and easier to fabricate. This gives a substantial reduction in both tooling costs and parts cost.

A BRIEF DESCRIPTION OF THE DRAWINGS

DETAILED DESCRIPTION

Figure 1:
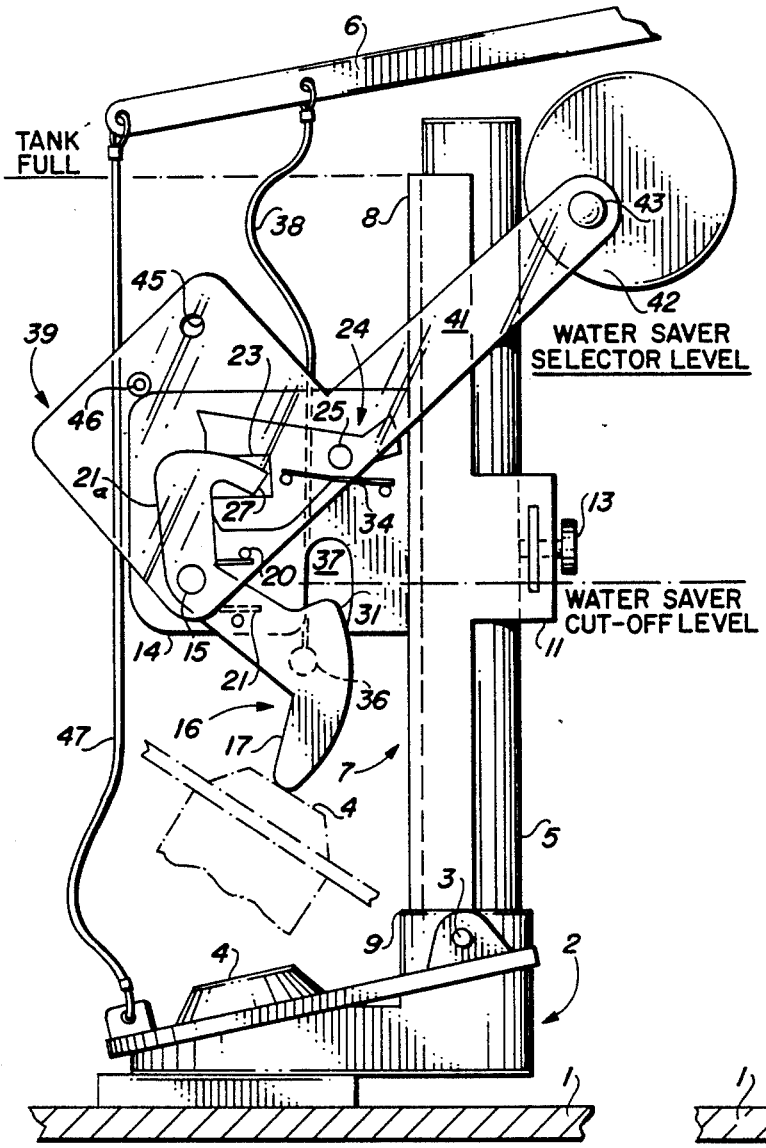
FIG. 1 is a front elevation of the unit installed in a flush tank with the parts shown in positions assumed between flushes after a water saver flush.

In FIG. 1, reference character 1 indicates the bottom of a conventional flush tank having an outlet fitting 2 provided with pivots 3 supporting a conventional flapper float type flush valve 4. This outlet fitting also supports a conventional overflow pipe 5 extending above the water level. The flush tank also includes a conventional flush lever 6 which is raised by pushing down on an external flush lever (not shown).

Figure 3:
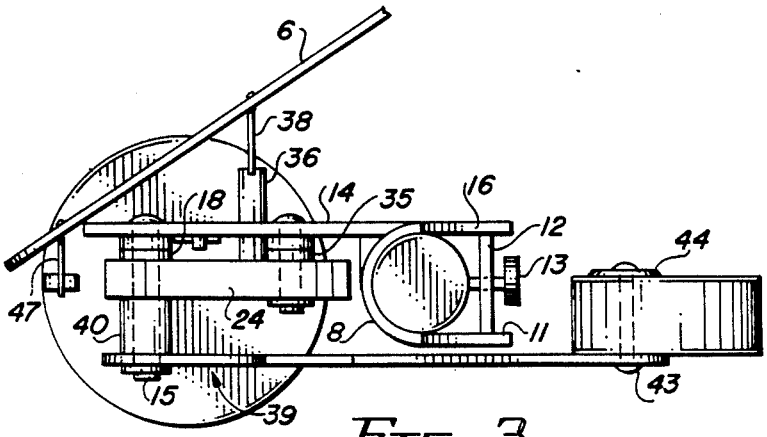
FIG. 3 is a top view of FIG. 1 with the float lever at water saver cut-off position.
Figure 6:
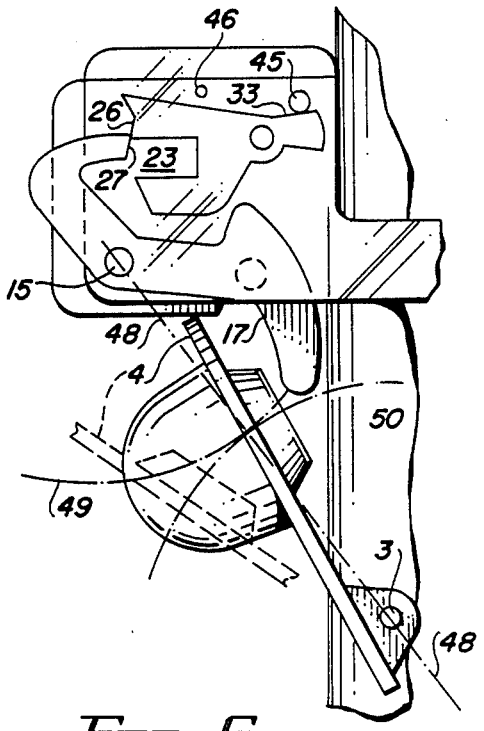
FIG. 6 is a fragmentary view of the parts just before the water saver cut-off.

Mounted on the overflow pipe 5 is a base member generally indicated as 7. This base member includes an elongated semi-circular section 8 (FIG. 3) fitting over the overflow pipe 5. This section rests on a shoulder 9 of the outlet fitting 2. It is provided with mounting extensions 11 and 12 extending to the other side of the overflow pipe and carrying a clamping member 12 which carries a set screw 13. Tightening the set screw 13 clamps base member 7 to the overflow pipe. This mounting bracket or base member carries a mechanism support 14 which is molded integral with the base member. This mechanism support carries a shoulder pivot pin 15 located approximately at the water saver level. The pin 15 supports a flapper valve operator genarally indicated as 16. This operator has a valve engaging portion 17 extending downwardly and toward the overflow pipe to a point where it engages the back of a flapper valve when opened as shown in FIG. 6. The valve operator also includes a hub 18 which spaces it from support 14 so that it engages the center of the flapper valve 4. This hub and the shoulder on pin 15 support a biasing spring 19. This spring is of a torsion type and has one leg bearing on a pin 20 formed on the mechanism support and its other leg 21 bearing on a pin formed on the valve operator. This spring biases the valve operator downwardly for closing the flapper valve.

The valve operator 16 also includes a latching section **21*a* including an arcuate portion 22 which extends into the slot 23 of latch 24 as shown in FIG. 1. This latch is supported on the mechanism base by a pivot pin 25 which is spaced from the operator pivot pin 15. As better shown in FIG. 5 this latch includes a primary supporting surface 26 which faces away from the pivot 25 and is engaged during a flush by the end 27 of the arcuate section 22 of valve operator 16. This holds the valve operator in inactive position as shown in FIG. 6. The latch also includes a float blocking section 28 merging with the supporting surface 26. It also includes a secondary supporting surface 29 on the other side of notch 23. The latch also has a driven surface 30 which is engaged by a driving surface 31 on the valve operator 16. The latch also includes a driving portion 32 having a driven surface 33. This latch is biased dowmwardly by a torsion spring 34 fitting over hub 35 on the latch and a shoulder formed on pivot pin 25. This spring bears on a pin formed on the back of a latch and another pin formed on the mechanism base 14**.

The valve operator 16 is provided with a pin 36 which extends rearwardly through a slot 37 in base 14. This pin is connected to the flush lever 6 by a flexible connection 38.

Also mounted on the pivot pin 15 is a float lever generally indicated as 39. This lever is molded of thermo-plastic material which in this illustration is transparent allowing the parts behind it to be shown in full lines. Float lever 39 includes a hub 40 fitting over pivot pin 15 and spacing the lever extension 41 from the base 7. This lever extension extends toward and beyond the overflow pipe and at its end carries a float 42. This float is mounted off-center by a rivet 43 and a tension washer 44 (FIG. 3) allowing rotation of the float on the arm 41. This provides a limited adjustment for the water saver cut-off point. The float lever also includes a rearwardly extending operator pin 45 and a float disabling pin 46 of smaller diameter.

OPERATION

FIG. 1 shows the parts in the position assumed after a water saving flush and after the tank has refilled. The float 42 is in its uppermost position. The arcuate section 22 of valve operator 16 is in notch 23 of latch 24. This causes portion 17 of the operator to be in its lowermost position where it has pushed the flapper valve 4 to the dotted line position from which its snaps to closed position by the downward flow of water. The flapper valve 4 is now closed and the tank has refilled.

Figure 2:
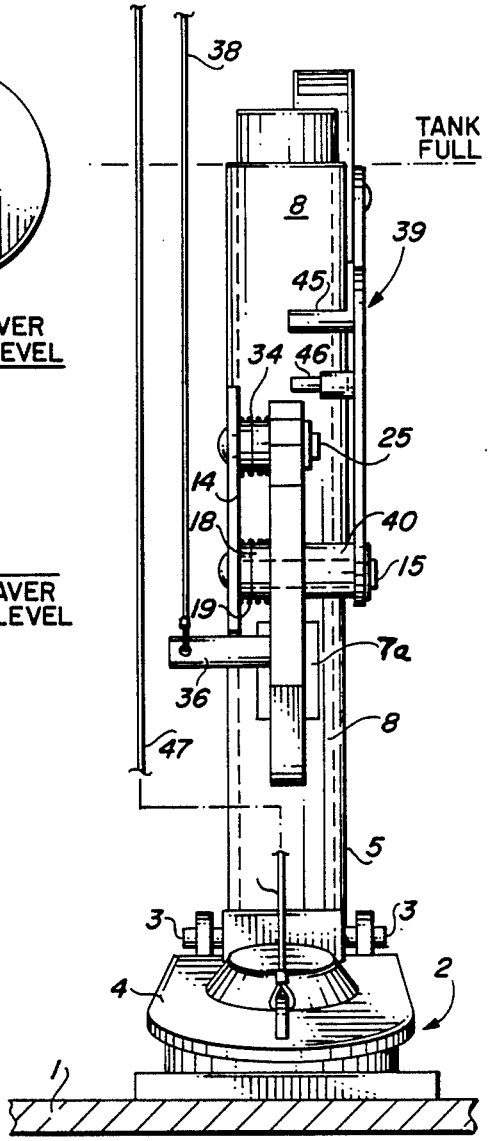
FIG. 2 is a side view of FIG. 1.
Figure 4:
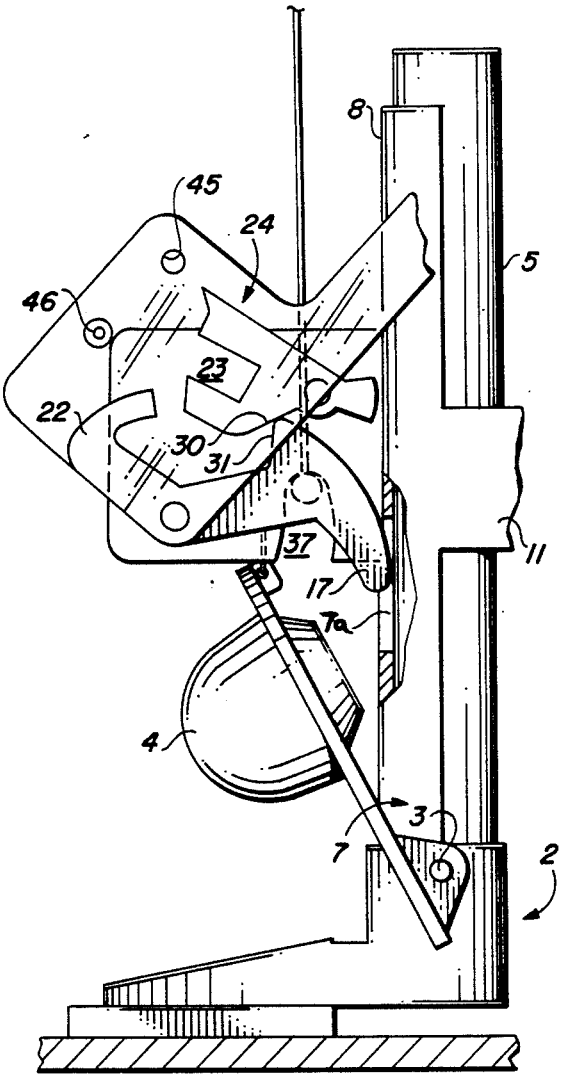
FIG. 4 is a fragmentary view like FIG. 1 but at the start of a flush.

When a flush is desired, the user pushes down on the external flush lever (not shown) which raises the internal flush lever 6. This first takes up slack in link 47 and breaks the flapper valve loose from its seat. At this point the slack in link 38 is taken up and link 38 pulls upwardly on pin 36 which is part of a valve operator. This rotates the valve operator counterclockwise lifting the arcuate portion 22 out of the notch 23 of the latch 24. On continued upward movement of the flush lever 6, the driving portion 31 on the valve operator engages the driven portion 30 of the latch causing the latch to rotate clockwise to the position of FIG. 4. At this time the pin 36 on the operator engages the end of slot 37 in the mechanism base which stops further movement of the valve operator. As shown in FIGS. 2 and 4, the base 7 is provided with a notch *7a* into which the end 17 of the operator enters. This allows the valve operator 16 to move to the position shown in FIG. 4.

FULL FLUSH

When a full flush is desired, the operator holds the flush handle down a couple of seconds until the water level drops to the point market "Selector Level". At this time the selector pin 46 on the float lever reaches the position shown in FIG. 7. It engages the latching surface 26 of latch 24 behind the blocking surface 28. This stops downward movement of a float thus disabling a water saver flush. After this selector level is reached the user may release the flush handle allowing the internal flush lever to drop. This permits the valve operator to rotate until its latching end 27 engages the second latching surface 29 on the latch. This holds the operator in the same position shown in FIG. 6 where it allows full open movement of the flapper valve 4. The tank will now empty until the loss of buoyancy causes flapper valve to close in the regular manner. The tank will now refill and the float lever will reassume the position shown in FIG. 1. Latching section 27 on the valve operator will remain engaged with the surface 29 of latch 24 until the start of the next flush.

WATER SAVER FLUSH

Figure 5:
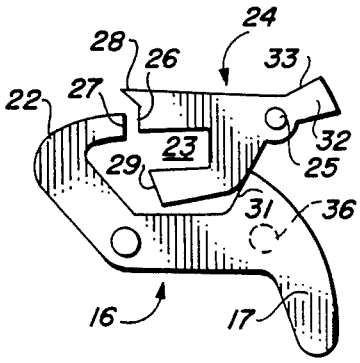
FIG. 5 is a fragmentary view of the parts after a flush is started just after the handle is released for a water saver flush.

When a water saver flush is desired, the user depresses the flush handle and releases it immediately. This allows clockwise rotation of the valve operator 16 which in turn allows counterclockwise rotation of the latch 24. As shown in FIG. 5, the latching surface 26 on the latch comes under the end 27 of the valve operator while end 27 and surface 26 are still spaced apart. The parts are preferably formed so that when end 27 engages surface 26 it also engages projection 28 on the latch which serves as a stop for further movement of the latch. Engagement of the latching surfaces 26 and 27 holds the valve operator in the inactive position shown in FIG. 6 allowing full opening of the flapper valve.

When the water level drops to the water saver cut-off level the float lever reaches the position shown in FIG. 6 where pin 45 on the float lever engages surface 33 of the latch. This rotates the latch until the latching surface 27 drops into the notch 23. This allows the valve operator to rotate back to the position of FIG. 1, pushing the flapper valve to closed position.

It should be noted that the location of pivot 15 for the valve operator relative to pivots 3 for the flapper valve is on a line 48 extending through the areas of contact of the operator with the valve at mid-stroke. The contacting area on the valve operator 17 travels in an arc 49 centered on the pivot pin 15, while the area of contact on the valve with the operator travels in an arc 50 centered on the flapper valve pivots 3. It should be noted these arcs travel in similar directions through the operating stroke of the valve operator. This minimizes rubbing between the two parts and keeps friction loss low.

ADJUSTMENT OF SELECTOR LEVEL

Figure 7:
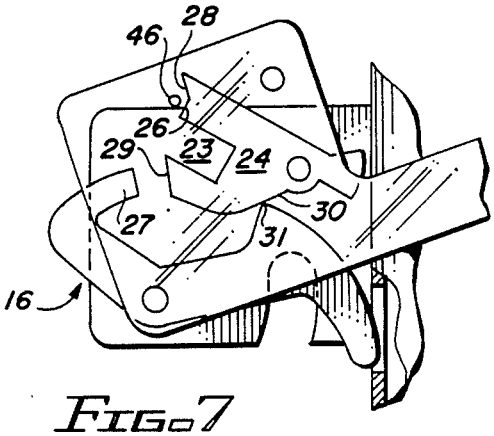
FIG. 7 is a view similar to FIG. 6 but shows the parts at the start of a flush with the handle still held down for a full flush.
Figure 8:
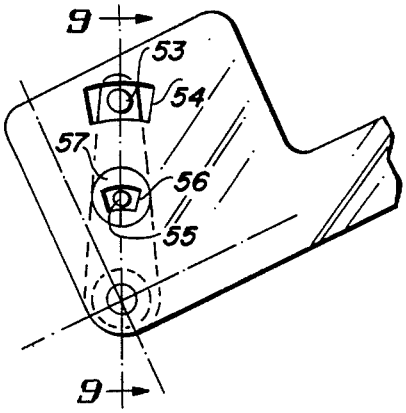
FIG. 8 is a front view of a modification providing for adjustment of the time the flush handle must be held down for a full flush.
Figure 9:
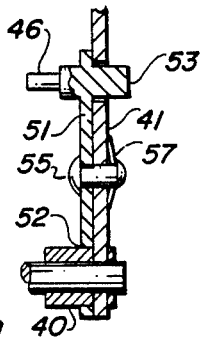
FIG. 9 is a side view in section of FIG. 8

If desired the operating pin 46 on the float lever may be made adjustable so that the user may adjust the water saver selector level to suit his needs. An arrangement providing this is shown in FIG. 8 and 9. Here the selector pin 46 is formed on a lever 51 having a hole 52 fitting over hub 40 of the float lever 41. Lever 51 also includes a handle portion 53 extending through a slot 54 in the float lever. The adjusting lever 51 is held in adjusted position by means of a rivet 55 passing through a slot 56 and carrying tension washer 57. Movement of the pin 53 to the right as seen in FIG. 8 advances the point at which the float is blocked as shown in FIG. 7, thus shortening the time required for selecting a full flush.

From the foregoing it will be apparent that the invention provides a low cost simplified water saver which can be easily installed by unskilled people and which gives the user a selection between full flush and a water saver flush.

I claim:

1. A water saver control for a toilet flush tank having an outlet, an overflow pipe means, a flapper-float type valve for the outlet mounted on pivots on the overflow pipe means and an externally operated flush lever connected to the flapper valve for opening same on upward movement of said lever, said flapper valve being of the type that holds itself open due to its buoyancy until the tank is empty, the combination of, operator pivot means supported in the tank, a flapper valve operator mounted on said operator pivot means, said pivot means being located above the flapper valve and the operator being arranged to extend downwardly from its pivot means to a contact area with the back of the flapper valve when open to push the valve toward closed position against its buoyancy on rocking of the operator in one direction, the pivot means being located relative to said contact area and flapper valve pivots to cause the areas of contact on the flapper valve and operator to travel in general directions similar enough to avoid substantial rubbing to provide for low friction loss in pushing the valve by the operator, operating means including a float constructed and arranged to rock the operator in said one direction to close the valve in response to falling water to a water saving level, a latch pivot spaced from the pivot means, a latch on said latch pivot having a supporting surface arranged to hold the operator in inactive position allowing the flapper valve to remain open, the operator being biased to close the valve, and means operated by the float on reaching the water saver level in the tank for releasing said latch.

2. The combination recited in claim 1 in which the latch is biased to bring the supporting surface into supporting position relative to the operator when the operator is lifted to clear the supporting surface, and means operated by the flush lever for lifting the operator at the start of a flush.

3. The combination recited in claim 2 in which the latch includes a blocking portion for stopping downward movement of the float when moved into blocking position, and means actuated by the valve operator when lifted by the flush lever for moving the latch to blocking position.

4. In a water saver for a toilet flush tank having an outlet flush valve and a manually operated flush lever for opening the valve when moved to flushing position, the combination of, operating means for controlling closure of the valve at a water saving level, said operating means including a float, a rotating latch and latched means held by the latch, the latch being constructed with a pivot and a holding surface facing away from the pivot, said latched means being constructed to bear on said holding surface when latched and to move inward toward the pivot when the latch is rotated to released position where the holding surface is out of contact with the latched means, valve closing means controlled by inward movement of the latched means for closing the valve, and means operated by the float on drop in water level for moving the latch to released position.

5. The combination recited in claim 4 in which the latched means is mounted on a pivot and the valve closing means is a lever mounted on the same pivot.

6. The combination recited in claim 5 in which the latched means and valve closing lever are formed of a single integral part.

7. In a water saver for a toilet flush tank having an outlet flush valve and a manually operated flush lever for opening the valve when moved to flushing position, the combination of, operating means for controlling closure of the valve at a water saving level, said operating means including a latch having a supporting surface, and latched means held by the latch supporting surface constructed to cause closure of the valve when released by the latch, means for moving the latched means to a position held by the latch and float means constructed to release the latched means from the latch on drop in water level to a water saving level, said latch having a portion arranged to disable the float means when the latch is moved to a predetermined position for causing a full flush and means operated by the flush lever for moving the latch to said predetermined position.

8. The combination recited in claim 7 in which the means for moving the latched means to a position held by the latch is operated by the flush lever.

9. The combination recited in claim 7 in which the latched means includes a driving surface engaging a driven surface on the latch for moving the latch to said predetermined position.

10. The combination recited in claim 7 in which the latch has a second supporting surface constructed to support the latched means when the latch is moved to the predetermined position disabling the float means.

11. A water saver control for a toilet flush tank having an outlet, an overflow pipe means, a flapper-float type valve for the outlet mounted on pivots on the overflow pipe means and an externally operated flush lever connected to the flapper valve for opening same on upward movement of said lever, said flapper valve being of the type that holds itself open due to its buoyancy until the tank is empty, the combination of, a mounting bracket mounted on the overflow pipe means, said bracket including a mechanism support extending from the overflow pipe means above the flapper valve, said support having pivot means extending therefrom above the the flapper valve and generally parallel with the flapper valve pivots; a valve operator lever mounted on said pivot means and extending downwardly toward the overflow pipe means to a contact area with the back of the flapper valve when open to push same toward closed position on rocking of the operator in one direction; and means including a float lever extending from the pivot means toward and beyond the overflow pipe means for rocking the operator in said one direction to close the valve in response to falling water to a water saving level.

12. The combination recited in claim 11 in which the valve operator and float lever are mounted side by side on a single pivot, the valve operator being adjacent the mechanism support.

13. The combination recited in claim 11 including a latch mounted on a pivot spaced from the pivot means and arranged to restrain the operator from closing the flapper valve, and means operated by the float lever for releasing the latch.

14. The combination recited in claim 11 including blocking means carried by the mechanism support for blocking downward movement of the float lever to provide a full flush, means actuated by the valve operator for moving the blocking means into blocking position, and means operated by the flush lever at the start of a flush for moving the valve operator to cause blocking of the float lever.

15. The combination recited in claim 14 in which the blocking means is part of the latch.

16. The combination recited in claim 15 in which the mechanism support is arranged to limit movement of the valve operator by the flush lever.

17. A water saver control for a toilet flush tank having an outlet, a valve for the outlet arranged to close when the tank is empty and an externally operated flush lever for opening the valve to start a flush, the combination of a valve operator arranged to close the valve, a latch arranged to hold the valve operator in an inactive position when engaged and to allow movement of the operator to close the valve when disengaged means activated by the flush lever on starting a flush for moving the valve operator to inactive position, float means arranged to disengage the latch on drop in water level to an intermediate water saving level, means for disabling the float means to provide a full flush, and means activated by the valve operator for activating said disabling means.

* * * * *